US007766065B2

(12) United States Patent
Verhaar

(10) Patent No.: US 7,766,065 B2
(45) Date of Patent: Aug. 3, 2010

(54) DRYWALL TAPE DISPENSER

(76) Inventor: John Verhaar, 14692 Van Buren St., Midway City, CA (US) 92655

( * ) Notice: Subject to any disclaimer, the term of this patent is extended or adjusted under 35 U.S.C. 154(b) by 832 days.

(21) Appl. No.: 11/598,852

(22) Filed: Nov. 13, 2006

(65) Prior Publication Data

US 2008/0110573 A1 May 15, 2008

(51) Int. Cl.
*B05C 3/02* (2006.01)

(52) U.S. Cl. ..... 156/575; 156/577

(58) Field of Classification Search ..... 156/574, 156/575, 577; 118/123, 405
See application file for complete search history.

(56) References Cited

U.S. PATENT DOCUMENTS

| | | | | | |
|---|---|---|---|---|---|
| 2,348,166 | A | | 5/1944 | Cavanaugh | |
| 2,570,379 | A | * | 10/1951 | Robinson | 118/405 |
| 3,007,837 | A | * | 11/1961 | Goode, Jr. | 156/461 |
| 3,023,728 | A | * | 3/1962 | Ort | 118/32 |
| 3,138,512 | A | * | 6/1964 | Partin | 242/588.2 |
| 3,188,262 | A | * | 6/1965 | Torrison | 156/461 |
| 3,344,770 | A | | 10/1967 | Schaefer et al. | |
| 4,367,692 | A | | 1/1983 | Underwood et al. | |
| 4,757,783 | A | | 7/1988 | Matheny | |
| 5,029,552 | A | | 7/1991 | Ovens | |
| 5,137,752 | A | * | 8/1992 | Mills | 427/179 |
| 5,498,287 | A | * | 3/1996 | Barnfield | 118/43 |
| 5,676,793 | A | * | 10/1997 | Martin et al. | 156/578 |
| 5,736,001 | A | | 4/1998 | Samuelson | |
| D438,770 | S | * | 3/2001 | Wagner | D8/51 |

* cited by examiner

*Primary Examiner*—Mark A Osele
(74) *Attorney, Agent, or Firm*—J. Curtis Edmondson

(57) ABSTRACT

Disclosed is a device for applying drywall tape and grouting compound to drywall. The invention is operative to simplify the application of drywall tape and an appropriate amount of grouting compound to a joint. Conveniently, the device is placed on a standard size tub of drywall grouting compound, such that compound adheres the drywall tape as it is drawn through the device by one applying tape to a joint to be filled. Various embodiments of the present invention permit the easy application of tape and compound to joints on flat surfaces as well as in corners.

4 Claims, 1 Drawing Sheet

DRYWALL TAPE DISPENSER

BACKGROUND OF THE INVENTION

1. Field of the Invention

The present invention is in the field of drywall tape applicators and systems, and in particular to an improved drywall tape and joint compound applicator system.

2. Discussion of the Related Art

It is common in the construction industry to use gypsum board drywall products in the finishing of interior walls and ceilings. A number of pieces of gypsum board will typically be attached with screws or nails to a frame backing in order to completely cover a wall. Eventually, the drywall will be finished by the application of paint, wallpaper or other texturing materials.

Prior to finishing the wall or ceiling any gaps, also known as joints or seams, between individual pieces of gypsum board are filled so that the wall or ceiling takes on the character of a single smooth surface. A typical method of finishing involves the application of a drywall joint compound to a seam, overlaying the compound with a drywall tape, and then applying additional compound over the tape. The tape is smoothed, and excess joint compound removed, by scraping the taped area with a hand trowel. After the compound has dried the surface is sanded to a smooth finish prior to final finishing with paint, wallpaper and the like.

While simple methods provide an advantage in minimizing the amount of equipment required to perform a drywall job, they nonetheless suffers from a number of limitations. For example, applying the correct amount of joint compound takes a significant degree of skill in order to avoid using too much or too little compound. Gaps in the application of compound are especially problematic as uncompounded tape will not adhere to the gypsum board, and will frequently lift away from the surface, or curl at the edges, creating an obvious imperfection on the wall or ceiling being finished.

Similarly, drawing the drywall tape by hand through a reservoir of joint compound can be awkward, especially for a user working alone. Such problems increase the time required to perform a drywall job, affect the consistency of the drywalling process, as well as adversely affect the aesthetic quality of finished walls and ceilings.

Consequently, various drywall tape application systems have been devised in order to simplify the drywall process and improve the consistency of the finished product. For example, U.S. Pat. No. 3,348,166 (Cavanaugh et al.) discloses an apparatus for feeding drywall tape through a container so as to enable a coating of joint compound to be applied to the tape.

U.S. Pat. No. 3,344,770 (Schaefer et al.) discloses an apparatus for dispensing a strip of material such as drywall tape, and which provides for attachment to a bucket containing an adhesive, and a squeegee device to regulate the amount of adhesive applied to the strip of material.

U.S. Pat. No. 4,367,692 (Underwood & Radtke) discloses a joint compound dispenser in which wallboard joint tape is coated with joint compound as the tape is drawn through a container of the compound, and then out an exit slot that regulates the amount of compound adhering to the tape. The device also permits the tape to be drawn upwardly for application to a wall, without causing the compound to be removed by the top edge of the exit slot.

U.S. Pat. No. 4,757,783 (Matheny) discloses a combined tape dispenser and joint compound container. Tape is drawn through the container, within which is a channel operative to dispense joint compound onto the tape as it is drawn through the container. An adjustable metering gate regulates the amount of compound retained on the tape.

U.S. Pat. No. 5,029,552 (Ovens) discloses a container attachment device for applying plaster or cement to a tape passing through a container of said plaster or cement. The device is an elongated housing that causes the tape to be passed through the plaster contained in a pail, and a blade to ensure an even thickness of plaster is applied to the tape before it leaves the pail.

U.S. Pat. No. 5,736,001 (Samuelson) discloses a combined joint compound hopper and tape dispenser. Compound is applied to the tape by drawing the tape through the joint compound contained in the hopper. Passing the tape through two pinch rollers removes excess compound, thus regulating the amount of compound adhering to the tape.

Although these prior art devices generally serve their purpose, they nonetheless each have limitations that affect their overall usefulness. For example, in many of these devices the container for the joint compound is separate from the drywall tape applicator. These containers may further be complicated devices that add to the cost of equipment needed to perform a drywall operation. Still others are devices that combine the tape dispensing and compound containing functions, requiring the transfer of compound from the container it is purchased or prepared in to the hopper of the dispensing device.

Still others are limited by the fact that tape cannot be pulled from the dispenser in a position above or below the joint compound-metering device without scraping off compound from one side of the drywall tape.

Thus, it would be desirable to have a drywall taping device that is easy to use, simple to manufacture and avoids problems associated with prior art devices.

SUMMARY OF THE INVENTION

It is thus an object of the invention to provide an improved drywall tape dispenser that avoids many of the problems inherent in prior art tape dispenser designs.

It is a further object of the present invention to provide a drywall tape dispenser device that conveniently attaches to a joint compound container. In one embodiment the joint compound container comprises a 5-gallon pail. In yet other embodiments the joint compound container could be of differing size or shape.

It is yet another object of the present invention to provide a drywall tape dispenser that allows for even application of joint compound to both sides of a section of drywall tape, regardless of the amount of joint compound in the compound container.

Still another object of the present invention is to provide a drywall tape dispenser that can be used to apply drywall tape to either flat surfaces or corners formed by adjacent pieces of wallboard.

Another object of the invention is to provide a drywall tape dispenser that provides an even coating of joint compound to a piece of drywall tape. The invention further avoids the inadvertent scraping of joint compound from the drywall tape regardless of the angle at which the tape is pulled from the dispenser.

The present invention provides a series of guide pins to direct the drywall tape into joint compound in a container, and then once the drywall tape has been coated with the joint compound directs the tape out of the housing through a tape exit opening. In one embodiment the tape exit opening is rectangular, while in other embodiments the opening forms a right angle or other angle. In yet another embodiment the tape exit opening is adjustable. An angled opening conveniently imparts a bend along the midline of the drywall tape, making it easier to place the tape in places such as corners, or where walls and ceilings meet.

The tape exit opening is novel in that the opening further comprises spacer ridges, the ridges functioning to prevent drywall joint compound from being scraped from the drywall tape as the tape is withdrawn from the device. The width of the opening is chose such that a predetermined amount of drywall joint compound remains adhering to the tape, with excess compound scraped from the tape and retained in the container.

The device further includes a cutter so that the operator may cut the coated tape to essentially any desired length.

A further advantage of the present invention is that it is a simple device, readily manufactured from lightweight materials such as plastic and thus is economic and easy to transport from location to location by a user. In addition, the present invention is simple to use, clean and is adaptable to a wide range of joint compound container styles.

DETAILED DESCRIPTION

Figure 1A:
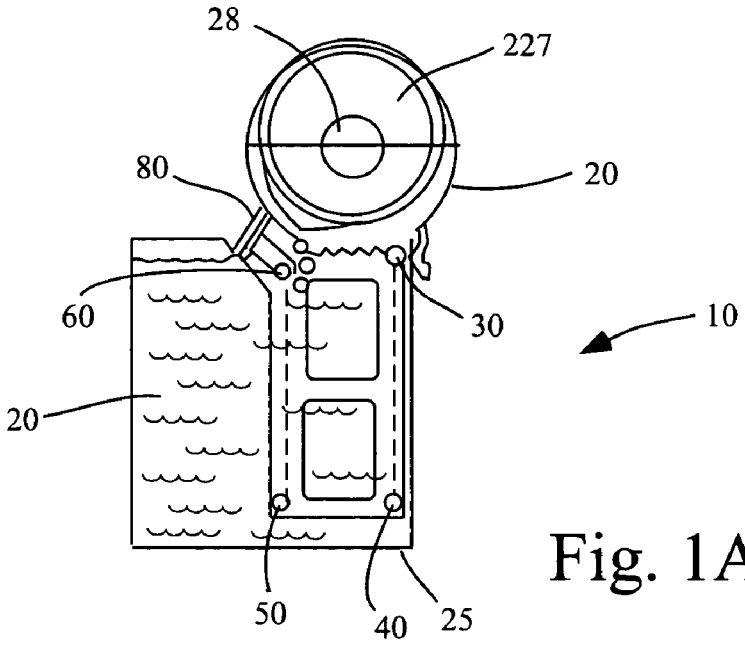
FIG. 1A is a side cut away view of the tape dispenser installed in a five-gallon bucket.
Figure 1B:
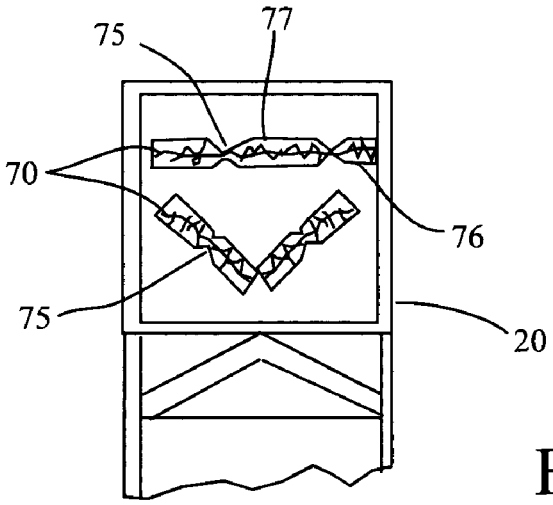
FIG. 1B is a top view of the tape exit portion of the tape dispenser.
Figure 1C:
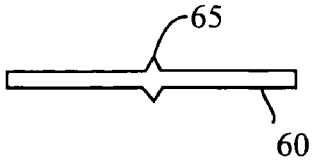
FIG. 1C is a front view of the fourth guide pin.

The present invention is a drywall taping device 10 that is an improvement upon prior art taping devices. The device is operative to apply a desired amount of drywall taping compound 26 to a section of drywall tape 227, and then place the drywall tape and adhering compound in a desired location at a drywall joint formed by two adjacent pieces of drywall.

In one embodiment, the drywall taping device comprises a housing 20 that may be reversibly mounted on a container 25 of drywall joint compound. Conveniently the container may be a 5-gallon pail or other like container in which drywall joint compound is typically supplied. Other embodiments might include a housing that is manufactured as part of the container, or ones that comprise a variety of means of attachment. For example, the housing might comprise screws, clamps or other like fasteners to permit secure placement of the housing on the container. Such variations on the housing design are obvious to those skilled in the art and not considered to be limiting with respect to the operation of the invention.

Conveniently, the housing also includes a holder 28 that accepts a standard roll of drywall tape. The holder allows for the easy dispensing of tape as required by the operator.

Within the housing portion of the invention there are placed several guide pins that serve to guide the drywall tape into the container of joint compound, through the joint compound and then to direct the tape upwards out of the container and through an exit opening formed in one side of the housing. In operation the drywall tape is threaded through these pins, the pins defining a path through the housing that results in the coating of both surfaces of the drywall tape with joint compound, and the exit of the drywall tape from the housing, with a desired amount of compound remaining adhered to both surfaces of the tape.

A first guide pin 30 is mounted near the top of the housing, generally parallel to axis of rotation of the holder 28. The drywall tape will be threaded over the first guide pin in such a way as to direct the drywall tape into the container in a generally downward direction.

A second guide pin 40 is situated near the bottom of the housing, parallel to the first guide pin. A third 50 guide pin is also located near the bottom of the housing lateral to the second. The second and third guide pins guide the tape along the bottom of the container, such that both surfaces of the drywall tape will become completely coated with drywall joint compound.

In one embodiment, the tape and adhering joint compound are then drawn upwards from the third guide pin to a fourth guide pin 60. In contrast to the first three guide pins, the fourth pin further comprises ridges 65 within the area contacting the drywall tape. The ridges serve to lift the drywall tape away from the pin, such that the tape glides along the fourth pin on the surface of the ridges. This prevents scraping off of drywall compound as the tape is directed towards an opening in the housing that defines the tape exit 70.

Other embodiments may omit the fourth guide pin such that the drywall tape follows a path directly from the third guide pin to the tape exit 70, the shape of the tape exit defining the amount of drywall joint compound that will remain on the drywall tape as it exits the device.

Each end of a guide pin will be engaged in the side of the housing such that the pin is relatively fixed in place. The guide pins will be generally cylindrical in shape to allow the drywall tape to glide easily along its surface; rotation of the pins is not required for the invention to function, but both fixed or rotating guide pins may be used, and thus the precise means of attaching the guide pins to the housing are not limiting of the scope of the invention.

The precise length of each guide pin is likewise not critical to the proper functioning of the invention, although each should be at least as long as the drywall tape is wide for easy engagement and movement of the tape. The guide pins may further comprise flanges at each end to help maintain the drywall tape in a substantially centered position along the face of the guide pin, although the same function may be performed by fashioning the internal dimensions of the housing to a size that just accommodates the width of the drywall tape; in such a case, the pins would not require flanged ends for proper function.

Thus, in one embodiment the dimensions of the housing, tape holder, guide pins, and tape exit 70 of the device is adapted for use with standard width (approximately 2" wide) drywall tape.

The tape exit 70 in the housing comprises an opening of dimensions sufficient to permit the easy withdrawal of the drywall tape and adhering joint compound from the housing by an operator. The opening is of sufficient width to accommodate the width of the drywall tape being used, and is made of such a depth that a desired amount of joint compound remains adhering to the drywall tape as the tape is withdrawn from the housing.

In addition, the tape exit further comprises at least one spacer ridge 75, the spacer ridge protruding partially into the opening portion of the tape exit. The novelty of the invention lies in the fact that the spacer ridges are operative to prevent the tape from rubbing against either the lower 76 or upper edge 77 of the opening when the tape is withdrawn from the exit in any manner other than directly from the opening. Thus a space between the edges of the opening and the drywall tape is maintained with joint compound that has been adhered to the drywall tape as the tape passes through the device remains on the tape. The thickness of the compound layer on each surface of the tape is readily determined by the width of the tape exit opening.

Prior art devices lacking the spacer ridges of the present invention suffer from the fact that joint compound is scraped from either the upper of lower surface of the drywall tape when the tape is withdrawn at an angle relative to the opening. The result is that the tape may not have sufficient joint compound to allow the tape to properly adhere to the drywall being filled. In contrast, in the present invention, spacer ridges maintain a spacing between the drywall tape and the opening such that regardless of the angle at which the tape is withdrawn from the tape exit, sufficient compound will remain adherent to both surfaces of the drywall tape.

In one embodiment the tape exit is a fixed opening or slot in the side of the housing. Alternatively, in other embodiments the tape exit might comprise two parallel rollers, the rollers spaced apart at a distance equal to the thickness of joint compound that ones desires to have on each surface of the drywall tape, and spacing flanges on the rollers to ensure that a space between the tape and each roller surface is substantially maintained.

In other embodiments, the tape exit 70 may comprise an opening other than a rectangle shape. For example, it is often desirable to place drywall tape at joints formed in corners or at the junction of wall and ceiling pieces. In these cases the tape is easier to apply if it is pre-bent along the midline. Thus, the present invention further provides a tape exit in the form of a right angle in order to pre-bend the tape as it exits the housing so that it is in a shape that is easier to fit to corner joints.

In yet another embodiment the invention provides a tape exit opening whose angle is adjustable. Providing an adjustable opening allows the operator to vary the angle of bend in the drywall tape, such that the invention could be used to prepare tape for flat joints, right angle joints, or at joints that are at different angles as sometimes are found when producing creative shapes in wall or ceiling drywall. In embodiments where an angled tape exit is desired, a plurality of rollers would be used to define the angle.

Finally, the invention provides a cutter 80 that is used to cut the drywall tape to a desired length.

Accordingly, the improved drywall taping device provide a simplified, safe, easy to use and more effective apparatus for use in drywall operations, solving problems encountered when using prior art devices. Further, the description and illustrations are provided by way of example and are not intended to limit the scope or spirit of the invention. Those skilled in the art will be able to readily make minor variations in the design and manufacture of the invention. However, such variants are intended to be within the scope of the invention.

What is claimed is:

1. A drywall taping device operative to apply a desired amount of drywall taping compound to a drywall tape, and then place the drywall tape and adhering compound in a desired location at a drywall joint formed by two adjacent pieces of drywall, the drywall taping device comprising: a housing that is reversibly mountable on a container of drywall joint compound; a drywall tape holder operative to hold a roll of drywall tape to be used and from which the drywall tape can be withdrawn by an operator; a first guide pin extending across the housing that guides the drywall tape generally downwards in the container such that the drywall tape contacts the drywall joint compound in the container; a second guide pin, parallel to the first guide pin and positioned near the bottom of the container laterally relative to each other and operative to guide the drywall tape substantially along the bottom of the container and through the drywall joint compound; a third guide pin, situated parallel to and laterally relative to the second guide pin, operative to direct the drywall tape substantially towards a tape exit located at the to of the container, such that after passing over the guide pins and through the tape exit the drywall tape retains a coating of drywall joint compound; and wherein the tape exit in the housing comprising an opening, wherein the at least one tape exit further comprises a gap and at least one spacer ridge protruding into the gap; and wherein the gap is sufficient width to permit the unrestricted passage of the drywall tape, and of sufficient height such that a predetermined amount of drywall joint compound remains adhering to the drywall tape; and wherein the at least one spacer ridge is operative to restrict the amount of drywall compound that is scraped from the drywall tape as the drywall tape is drawn out of the housing through the at least one opening, such that the drywall tape retains a desired amount of drywall joint compound after the drywall tape has exited the at least one tape exit; and a cutting means to cut the drywall tape withdrawn from the tape exit to a desired length;

wherein said tape exit is substantially rectangular further comprising a fourth guide pin, situated substantially near the top of the housing and adjacent to the tape exit, the fourth guide pin being generally cylindrical and further comprising at least one ridge of a greater cross-sectional diameter than the fourth guide pin operative to prevent the removal of drywall joint compound from the drywall tape by creating separation from the fourth guide pin and the drywall tape as the drywall tape is directed towards the tape exit.

2. The drywall taping device of claim 1 comprising a plurality of tape exits, each individual tape exit forming a predetermined angle, such that an operator may select a desired bend angle to be imparted along the midline of the drywall tape as the tape is withdrawn from the taping device, by directing the drywall tape through one of the tape exits.

3. The drywall taping device of claim 1 wherein the tape exit is formed by substantially parallel rollers, the rollers further comprising spacing flanges such that the drywall tape and adhering joint compound exits the housing by passing through two adjacent rollers, and the spacing flanges maintain a predetermined spacing between each surface of the drywall tap and the adjacent roller surface.

4. The drywall taping device of claim 1, wherein the housing, the tape holder, the guide pins and the tape exit have a width sufficient to accommodate a standard 2" width length of drywall tape.

* * * * *